United States Patent [19]

Palac

[11] 4,094,678

[45] June 13, 1978

[54] METHOD OF MAKING CURVED COLOR CATHODE RAY TUBE SHADOW MASKS HAVING INTERREGISTRABLE ELECTRON BEAM-PASSING APERTURE PATTERNS

[75] Inventor: Kazimir Palac, Carpentersville, Ill.

[73] Assignee: Zenith Radio Corporation, Glenview, Ill.

[21] Appl. No.: 748,802

[22] Filed: Dec. 7, 1976

[51] Int. Cl.[2] ..... G03C 5/00; B44C 1/22; C23F 1/00

[52] U.S. Cl. ..... 96/36.1; 96/36.2; 156/656; 156/661

[58] Field of Search ..... 96/36.1, 36, 36.2; 29/DIG. 16; 156/11, 12, 16, 656, 661

[56] References Cited

U.S. PATENT DOCUMENTS

| | | | |
|---|---|---|---|
| 3,563,737 | 2/1971 | Jonkers | 96/36.1 |
| 3,679,500 | 7/1972 | Kubo et al. | 156/644 |
| 3,725,065 | 4/1973 | Fadnen | 96/36.1 |
| 3,770,434 | 11/1973 | Law | 96/36.1 |
| 3,889,329 | 6/1975 | Fazlin | 96/36 |
| 3,900,359 | 8/1975 | Bakewell | 96/36.1 |
| 3,909,311 | 9/1975 | Yamada et al. | 96/36.1 |
| 3,909,928 | 10/1975 | Sato et al. | 156/644 |
| 3,929,532 | 12/1975 | Kuzminski | 96/36.1 |
| 3,955,981 | 5/1976 | Stachniale | 96/36.1 |
| 4,013,498 | 3/1977 | Frantzen | 156/640 |

FOREIGN PATENT DOCUMENTS

| | | | |
|---|---|---|---|
| 2,558,335 | 7/1976 | Germany | 56/644 |

*Primary Examiner*—Mary F. Kelley
*Attorney, Agent, or Firm*—John H. Coult

[57] ABSTRACT

This disclosure depicts a low cost method of making curved color cathode ray tube shadow masks having interregistrable beam-passing aperture patterns. The method comprises providing flat mask master means and curved mask master means, the flat and curved master means having correlative master stencil patterns. Using the flat mask master means, there is photochemically formed in at least one side of a flat shadow mask blank a pattern of blind mask apertures whose individual blind aperture location is related to the end-product mask aperture location and whose individual blind aperture size, at least in a direction corresponding to the direction of electron beam scan across the mask, is greater than the desired end-product mask aperture size by a predetermined misregister tolerance value. The flat mask blank is precision-shaped into a predetermined three-dimensional configuration with the pattern of blind apertures referenced to indexing means defined by the mask. Using the curved mask master means, there is photochemically etched in the blank a pattern of through apertures coincident with the pattern of blind apertures but having individual through aperture size smaller by said predetermined tolerance value, at least in the said scan direction, than the blind apertures.

10 Claims, 29 Drawing Figures

METHOD OF MAKING CURVED COLOR CATHODE RAY TUBE SHADOW MASKS HAVING INTERREGISTRABLE ELECTRON BEAM-PASSING APERTURE PATTERNS

CROSS-REFERENCE TO RELATED APPLICATIONS

This application relates to, but is in no way dependent upon, copending applications, including: Ser. No. 535,780, filed Dec. 23, 1974 (now U.S Pat. No. 3,989,525); Ser. No. 654,130, filed Feb. 2, 1976 (now U.S. Pat. No. 4, 045,701); and Ser. No. 675,653, filed Apr. 12, 1976 (a second generation continuation of Ser. No. 285,985, filed Sept. 5, 1972 but now abandoned); all assigned to the assignee of the present invention.

BACKGROUND OF THE INVENTION

This invention is directed to a method of making a shadow mask for a color cathode ray tube. Color cathode ray tube shadow masks of the three-dimensionally curved type are conventionally made by a process in which a flat mask blank, typically 6 mil thick cold-rolled steel, is coated on both sides with a photosensitive, etchant-resistant material and then exposed from both sides through a registered pair of related mask masters. After exposure, the photoresist layers are developed and the blank is etched from both sides until a pattern of through apertures is formed in the mask blank. The blank is then shaped into the desired three-dimensional configuration and suitable processed for mounting in a color cathode ray tube.

As a result of the inevitable nonuniformities introduced during the process in which the flat mask blank is formed into a curved configuration, the end product shadow masks have mask aperture patterns which are not interregistrable -- that is to say, the variations in the locations of the mask apertures from mask to mask and the variations in mass aperture size, exceed maximum permissible tolerances.

As a result, it is standard practice today to use a finished shadow mask as the photographic stencil during the photo-deposition of a phosphor screen pattern. Since each phosphor screen is a unique replication of a particular shadow mask, and since all shadow masks are not interregistrable, it is necessary to "pair" or "mate" a given shadow mask with its uniquely associated phosphor screen throughout all factory operations on the tube, and to assemble the paired mask and screen at an appropriate stage of manufacture before the tube envelope is closed.

Because of the logistical problems which attend the pairing of masks and screens, and because of the cost associated with the afore-described pairing of masks and screens, it has long been a goal of color cathode ray tube manufacturers to develop a commercially practicable way to manufacture interregistrable shadow masks. In fact, the very first color cathode ray tubes manufactured did indeed have interregistrable masks. However, this was accomplished only by virtue of the fact that the masks and screens at the time were flat; the emanding tolerance constraints could thus be met. The resulting "flat pack" assembly of mask and screen soon became out-moded, performancewise, with the advent of the practice of screening the phosphor pattern directly on the concave inner surface of the color CRT faceplate. The use of curved screens and associated curved masks, however, rendered impracticable the making of interregistrable shadow masks.

The goal of finding an approach which would make possible the manufacture of interregistrable curved masks has remained an elusive one. U.S. Pat. No. 3,676,914-Fiore, discloses a method for making interregistrable three-dimensionally curved masks by which correlative flat mask masters are photographically projected onto photoresist layers on the convex and concave sides of a pre-curved shadow mask blank. The difficulties in accomplishing this flat-to-curve projection of the photographic master stencil patterns remains an obstacle to the perfection of this method of achieving interregistrability of curved masks.

A second approach, also noncommercial, to fabricating interregistrable curved masks is disclosed in U.S. Pat. No. 3,889,329 to Fazlin. There also, the mask blank is preformed before it is exposed from both sides. The Fazlin approach differs from the primary embodiment disclosed in the Fiore patent in that Fazlin's photographic mask masters are curved and are formed as part of a combined vacuum chuck and exposure lighthouse. The preformed blank is vacuum-clamped between the curved mask masters and is exposed to light sources located within vacuum chambers above and below the mask blank.

Yet another approach is achieving interregistrable curved shadow masks is to perform the mask blank into a curved shape, but rather than attempting to achieve the difficult step of exposing the convex side as well as the concave side of the curved blank, the photochemical etching of the mask is accomplished from the concave side only. A photographic master is used which is supported in close but nontouching relationship to the concave surface of the mask blank. This approach is described fully and claimed in the referent copending application. It is also disclosed, and aspects claimed, in U.S. Pat. Nos. 3,973,964 and 3,975,198, both assigned to the assignee of the present application.

Feasibility of the latter approach has been proven in the laboratory, however that approach, in its disclosed executions, employs an undesirably expensive mask blank material – a material having one one surface (ultimately the concave surface of the mask) a thin aperture-defining layer of nickel or other suitable material which is capable of withstanding the etching of mask apertures through the entire mask blank from the protected side only. In a preliminary operation, a pattern of apertures is etched in the aperture-defining layer. The underlying steel substrate is subsequently etched (through the apertures in the aperture-forming layer) using an etchant to which the aperture-defining layer is substantially resistant. Because of the highly competitive nature of the consumer television industry, the use of a mask material having a substantial price premium over simple cold-rolled steel stock may lessen somewhat the commercial attractiveness of the afore-described one-sided etch process.

OTHER PRIOR ART

German OLS No. 2,331,535 Japan No. 10853/65

OBJECTS OF THE INVENTION

It is an object of the present invention to provide an improved method of making curved color cathode ray tube shadow masks which are mutually interregistrable, which method is lower in cost than prior art methods.

Specifically, it is a object to provide a method of making curved color CRT shadow masks, which method does not have the requirement of photo-etching of shadow masks from the convex side, and yet which method can be carried out using standard cold-rolled steel shadow mask blank material.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings. In the several figures of which like reference numerals identify like elements, and in which:

DESCRIPTION OF THE PREFERRED EMBODIMENTS

Figures 1, 2, 3:
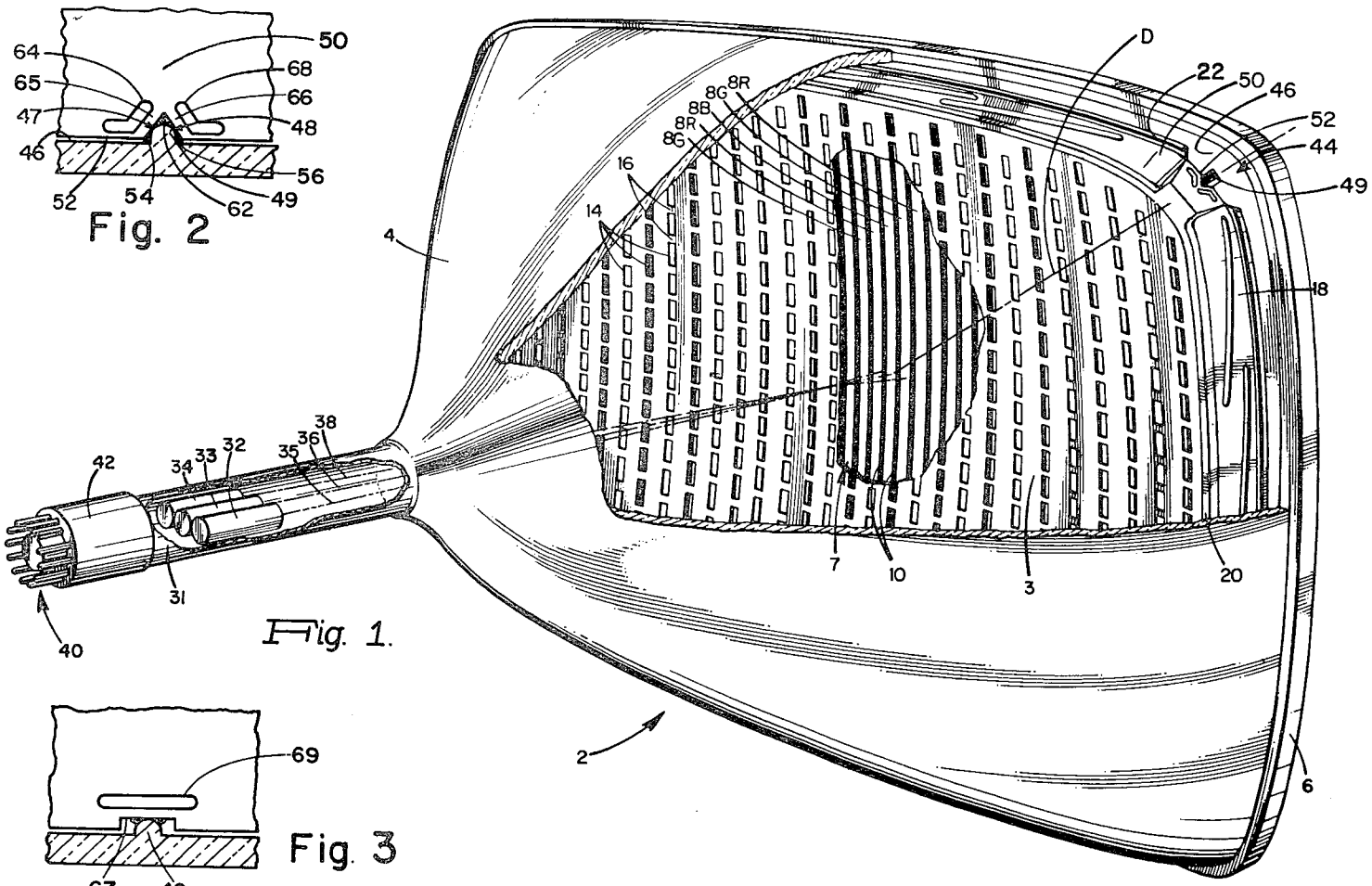
FIG. 1 is a perspective view, partly broken away, of a novel color cathode ray tube as seen from the rear, with a portion of the envelope cut away to reveal a shadow mask made following the method of the present invention.
FIG. 2 is an enlarged fragmentary view of a representative of one of three of the corners of the FIG. 1 tube, showing the structure by which the shadow mask is supported on the faceplate of the CRT.
FIG. 3 is a view of the fourth corner of the tube shown in FIG. 1.

This invention has general applicability for use in the manufacture of shadow mask color cathode ray tubes of various types, and more particularly in the manufacture of shadow masks of various configurations. FIGS. 1–3 depict a color cathode ray tube containing a shadow mask made according to the present invention. Before engaging a detailed description of the present method, a brief description of the color tube depicted in FIGS. 1–3 will be given.

The FIGS. 1–3 tube has as components a unique bulb and corner-mounted shadow mask. The bulb includes a flangeless faceplate which is used to impart the necessary rigidity to the mask. The mask has a low-cost, low-mass, non-self-rigid, torsionally flexible construction. The shadow mask is described and claimed in U.S. Pat. No. 3,912,963, assigned to the assignee of the present invention.

As used herein, the term "shadow-mask" is intended to encompass all tubes, including post-deflection focus tubes, in which a color selection mask or electrode achieves a shadowing effect, whether total or only partial. It is noted that the general concept of a low-mass, non-self-rigid, torsionally flexible shadow mask which is supported at its four corners so as to permit it to conform to the contour of a CRT faceplate was first described and claimed in the above-noted copending application of K. Palac, Ser. No.. 285,985. FIGS. 1–3 also reveals structure constituting the subject matter of the referent copending application Ser. No. 654,130 (now U.S. Pat. No. 4,045,701).

The tube 2 is depicted as having an envelope comprising a funnel 4 to a rectangular flangeless faceplte 6. The tube 2 is shown as having on the inner surface of the faceplate 6 a phosphor screen 7. The screen comprises an array of vertically oriented, horizontally repeating triads of red-emissive, blue-emissive and green-emissive phosphor elements 8R, 8B and 8G. As illustrated, the screen may be of the negative guardband, black matrix type as taught in U.S. Pat. No. 3,146,368. A black grille 10 comprises in this embodiment a pattern of the light-absorptive bands between the phosphor elements 8R, 8B and 8G.

A shadow mask 3 has a pattern of "slot" apertures 14, spaced by "tie-bars" 16, which define the beam landings on the screen (not shown). Briefly, the shadow mask 3 is non-self-rigid and may conveniently be of a frameless, one-piece construction metal-formed from a single sheet of electrically conductive materials such as 6 mil thick, cold-rolled steel. An integral skirt 18 shields the screen 7 from stray and overscanned electrons. The skirt 18 and integrally formed channel 20 and edge lip 22 enhance the stiffness of the mask with respect to its major and minor axes, while permitting the mask to flex with respect to its diagonals and thereby conform, when mounted, to the contour of the faceplate.

The tube is shown as including a neck 31, within which is contained an electron gun assembly. The electron gun assembly may take any of a variety of constructions, but in the illustrated embodiment wherein the mask is a slot mask cooperating with a screen of the "line"-type, the electron gun assembly preferably is of the "in-line"-type, comprising three separate guns 32, 33, 34 generating three coplanar beams 35. 36 and 38 which carry, respectively, red-associated, blue-associated and green-associated color video information. The electron gun assembly is electrically accessed through pins 40 in the base 42 of the tube.

FIGS. 1 and 2 show a mask suspension device 44 which is employed at three of the four corners of the mask 3. As will be explained in more detail below in connection with FIG. 3, the device for the fourth corner must hold the proper "Q" spacing (the spacing between the apertured region of the mask and the screen-baring faceplate surface), while allowing the fourth corner of the mask to seek an equilibrium position of its own plane.

Each of the mask suspension devices 44 has an envelope-associated component and a mask-associated component. In accordance with the invention claimed in the copending application Ser. No. 654,130, the envelope-associated component is shown as comprising a radially oriented integral modification of the inner surface 46 of the faceplate. The integral modification defines two engagement surface areas 47, 48 which are spaced tangentially (i.e., angularly as opposed to radially) on the faceplate. The engagement surface areas 47, 48 extend radially on the faceplate, and are convergent axially, i.e., in the direction of the central axis of the tube 2. The direction of convergence may be forwardly or rearwardly.

The mask preferably has the mask skirt 18 formed integrally therein. In each of three skirt corner portions 50 corresponding to the said three mask suspension devices 44, there is included a mask suspension element, preferably integral, for making a tangentially retentive, two point engagement with the engagement surface areas 47, 48 on the integral modification of the faceplate 6. The resultant six point engagement of the three mask elements with the three integral modifications in the said three corners of the mask effect a tangentially rigid, precisely reseatable coupling of the mask to the faceplate. In FIGS. 1–2, the integral modification of the faceplate inner surface is shown in the form of a boss 49, here shown as taking the shape of a ridge.

The skirt corner portion 50 is illustrated as including a mask suspension element, preferably integrally formed for cost reasons. The skirt corner portion 50 is shown as defining a knife-like free edge 52 which in turn includes two tangentially spaced edge elements 54, 56 for making to point engagement with the engagement surface areas 47, 48 on the boss 49. Forming the edge elements integrally with the mask has the advantage that the problem of tolerance accumulation which inevitably attends designs requiring separate mounting brackets, springs, etc., is absent.

It can be seen that because the engagement surface areas 47, 48 on the boss 49 are tangentially spaced in three corners of the mask 3, the resultant six points of engagement between the mask and the faceplate will very accurately fix and determine the spatial location of the mask relative to the faceplate inner surface, and will produce a very precise reseatability of the mask during tube fabrication, irrespective of the number of mask withdrawals from and reinsertions into the tube.

In order to immovably secure the mask to the faceplate when the tube is finally assembled; that is, in order to hold the mask corner portion on the boss 49, any of a number of securing means may be employed. The one illustrated in the present embodiment is a quantity of cement 62. The cement may be selected from a variety of suitable cements — e.g., frit cement (a devitrifying glass solder commonly used to hermetically seal the faceplate and funnel of color cathode ray tubes), hydraulic setting compounds, or sodium silicate or potassium silicate (water glass). The requirements of the cement are that it be capable of surviving the thermal cycles experienced during tube fabrication, that it not emit gases nor degenerate in any way which could cause injury to the tube, and that it be stable and maintain its adhesive integrity over the life of the tube. The cement must not be susceptible to fracture upon being subject to mechanical shocks, which may in practice reach as much as 40, 50 or even 100 G's. The cement must be able to withstand thermal cycling of the tube during which the mask will expand and exert force on the cement. This latter requirement is minimized by the invention of the application Ser. No. 654,130 (now U.S. Pat. No. 4,045,701), as will now be described.

As noted, since the mask 3 is relatively weak, it is desirable that the mask suspension not exert an unacceptably high radial loading on the mask during thermal cycling of the tube or during tube operation. An unduly high radial loading on the mask upon thermal expansion thereof would change its contour with resulting impairment of the accuracy of registration on the screen between the electron beam landings and the impinged phosphor elements.

To this end, and in accordance with an aspect of the invention of the said copending application, the said three mask corner portions (in this preferred embodiment the three skirt corner portions 50) are structured to have high radial compliance, i.e., to flex easily in the radial direction, when the mask expands thermally. In the FIGS. 1–2 embodiment, to produce this effect the skirt corner portions are each caused to be structurally weakened. This structural weakening of the skirt corner portion 50 is preferably accomplished, as shown, by having mask material removed from the skirt corner portions. More specifically, as shown in FIGS. 1 and 2, the skirt corner portions 50 each have an aperture pattern formed therein to effect such structural weakening thereof. In FIGS. 1–2, two apertures 64 and 68 are formed in the skirt corner portion around the mask suspension element 51.

To provide high radial compliance in the mask corner portions, the skirt corner portions each include at least one resilient strip-like section. In the FIGS. 1–2 embodiment one section is designated 65 and another 66. The strip-like sections 65, 66 have as side edges the edge elements 54, 56 and have as the opposed side edges the boundaries of apertures 64, 68, respectively. It can be seen that the sections 65, 66 will act like springs flexing as the mask expands and contracts to insure that no radial loads significant to deform the mask will be imposed thereon.

In order that the radial compliance of the mask corner portions is purely radial, as is preferred, the strip-like sections are desirably located on the mask corner portion symmetrically with respect to a mask diagonal, as shown.

As mentioned above, the mask suspension device for the fourth corner (FIG. 3) has requirements imposed upon it which are somewhat different from the requirements imposed upon the mask suspension devices for the other three corners. It should be kept in mind that the fourth corner suspension device is redundant. That is to say that the position of the mask in the plane of the mask is determined by the remaining three corners. The fourth corner must, in effect, not interfere with the spatial placement of the mask as determined by the remaining three mask suspension devices. However, the fourth corner must, of course, determine a correct Q-spacing for the fourth corner of the mask, that is a correct distance between the mask central portion and the inner surface of the faceplate.

In the fourth corner (FIG. 3), the notch comprised of edge elements 54, 56 is replaced by a straight-edged recess 67. A slit 69 in the mask skirt gives the fourth corner the desired high radial compliance. The free edge is cemented, but before the cement sets it is free to slide on the boss 49, thus permitting the spatial position of the mask to be dictated by the other three suspension means. When the cement sets, the high radial compliance provided by the slit 69 prevents distortion of the mask upon thermal expension thereof.

Figure 4:
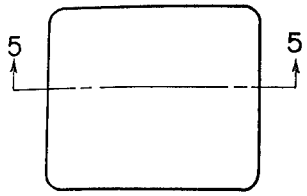
FIGS. 4–16 illustrate a method of manufacturing interregistrable shadow masks which implements the principles of the present invention.
Figure 5:
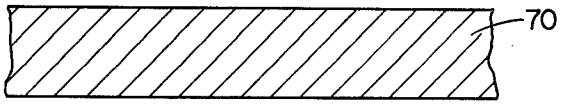

The present invention will now be described in detail, particularly with reference to FIGS. 4–16. FIG. 4 is a plan view of a shadow mask blank, which may be standard 6 mil cold-rolled steel. The present discussion is in the context of the manufacture of a shadow mask of the "slot"-type as shown in FIG. 1 at 3. The principles of the invention are equally applicable, however, to the manufacture of so-called "dot masks" wherein the apertures are circular. In accordance with this invention, the blank 70 is coated on both sides with layers 72, 74 of photoresist according to standard practice in the mask-making industry. The photoresist layers are then exposed from both sides through interregistered, correlative flat mask masters, which may be of the same character as conventionally used.

The photoresist layers 72, 74 are then developed and the blank 70 etched, again all according to standard techniques and practices. However, in accordance with this invention, rather than etching the blank 70 all the way through, the etching operation is stopped while the apertures being etched are still blind, i.e., the apertures are not true apertures but merely recesses. A second major departure from the standard practice is that the mask masters, while being of conventional construction, have a photographic stencil pattern which is slightly altered by having the individual areas in the master associated with apertures in the mask somewhat wider, for example 2–8 mils, than the desired ultimate mask apertures. The reason for this will become evident as this description proceeds.

Figure 7:
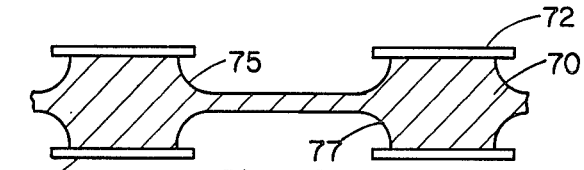
Figure 6:
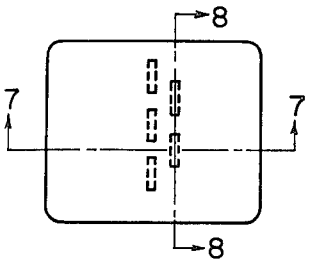
Figure 8:
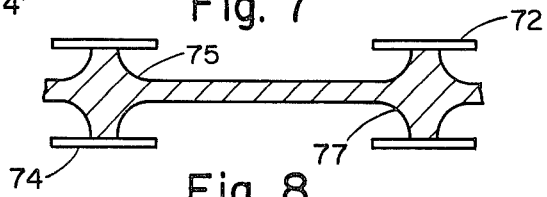

FIGS. 6–8 illustrate the mask blank 70 after it has been partially etched so as to create on opposite sides thereof registered patterns of blind mask apertures 75, 77 whose individual blind aperture location is related to the ultimate mask aperture location and whose individual blind aperture size, at least in a direction correspnding to the direction of electron beam scan across the mask, is slightly greater than the desired ultimate mask aperture size.

The next operation according to the present invention, which operation may be performed at an earlier stage if desired, is to form in or on the mask blank 70 on or more indexing means, here shown as four notches 76, one in each corner of the blank 70, which are accurately formed in the mask with reference to the registered patterns of blind apertures 75, 77. The present discussion concerns a mask of the type shown at 3 in FIG. 1 wherein notches in the corners of the mask plate with integral protuberances on the faceplate 6 of the tube 2. It will be understood that in the manufacture of masks of other types having other suspensions systems, the indexing means would not be notches in the corners but would be other suitable means referenced to the patterns of blind apertures 75, 77. The indexing means may or may not be used as part of the mask suspension system. According to the illustrated embodiment, however, the indexing means do indeed serve as an important part of the structure for suspending the mask on the color CRT envelope. In order that interregistrability of the end product shadow masks is achievable, it is important that the indexing means be accurately formed in the mask blanks, as by means of a nibbler with the blanks held in a precision jig.

Figure 11:
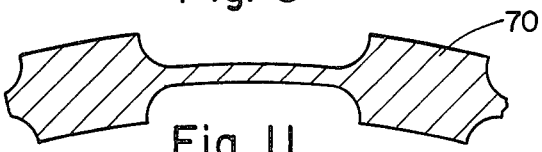
Figure 9:
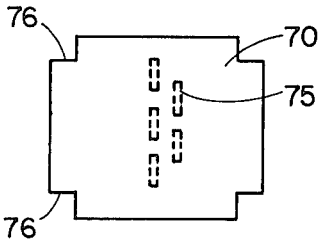
Figure 13:
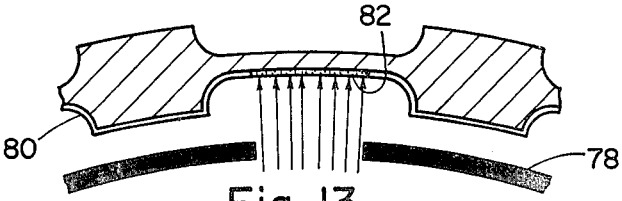
Figure 10:
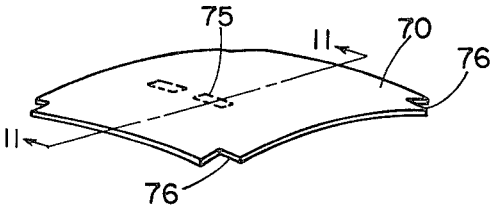

After the indexing means are formed in or on the mask blank 70, the blank is then precision-shaped into a predetermined three-dimensional configuration, as shown in FIGS. 10 and 11. It is noted that in an embodiment wherein the indexing means are discrete bracket-spring devices or the like, they are preferably installed after the mask blank is shaped.

Figure 12:
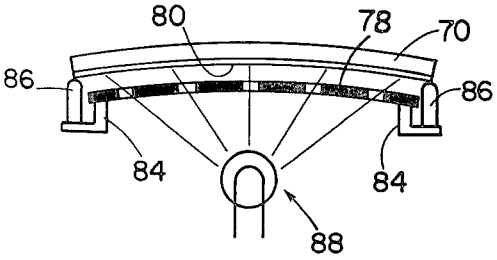

A curved mask master 78 having its photographic mask master stencil pattern correlated with that of the flat masters used to photochemically form the blind apertures 75, 77 in the blank 70 is used to expose a photoresist layer 80 which has been deposited on the concave inner surface of the formed blank 70. See FIGS. 12 and 13. FIG. 12 represents very schematically the said photo-exposure operation — elements 84 represent supports for the mask master 78; elements 86 represent supports for the blank 70. The support elements 84, 86 are located accurately with respect to each other. Item 88 is a source of ultraviolet radiation. The elements 86 are preferably structured to simulate the support elements on the faceplate which wil ultimately engage the notches 76 in the corners of the mask. The photoresist material may be of conventional type.

The exposure of the photoresist layer 80 on the concave inner surface of the blank 70 is preferably accomplished using the near-contact exposure techniques described and claimed in U.S. Pat. Nos. 3,975,198, 3,973,964 and 3,989,524.

The curved mask master 78 may be constructed as described in the latter-mentioned patents, with the exception, of course, that the means for supporting the mask master 78 would be modified to account for the different mask suspension system in the present application from that in the said patents. The photographic stencil pattern in the curved mask master 78 has areas 82 corresponding in location to the ultimate aperture location and corresponding in size to the end product shadow mask aperture size. In accordance with this invention, the width of the area 82 is, as can be seen, less than the width of the blind apertures 75, 77 formed in the blank 70. The width differential may, e.g., by about 2–8 mils. The width difference represents a tolerance which is provided to account primarily for errors introduced during shaping of the mask from a flat configuration into the desired thee-dimensional configuration. A small part of this tolerance is provided to accommodate errors introduced during the operation in which the indexing means are provided in or on the mask. In the illustrated embodiment wherein the indexing means are notches 76 formed in the corners of the mask, the amount of tolerance which must be provided for this purpose is relatively small. In other embodiments wherein, for example, spring-carrying brackets may be welded on the corners of the mask (as shown for example in the reference U.S. Pat. No. 3,975,198), a greater tolerance must be provided.

In the illustrated embodiment wherein a mask of the slot type is to be manufactured, it is preferable that the curved mask master 78 define a photographic stencil pattern in the form of vertical stripes correlative to columns of slots in the flat mask masters, but having a stripe width less than the width of the elements in the photographic stencil used to make the blind apertures 75, 77. The photographic stencil pattern on the curved mask master 78 is thus devoid of any stencil pattern component corresponding to tie-bars between the mask slots. By this expedient, the curved mask master does not have to be registered in the vertical direction with respect to the blind apertures, but need only be registered in the horizontal direction (the direction in which a tolerance for misregister has been provided).

Figure 14:
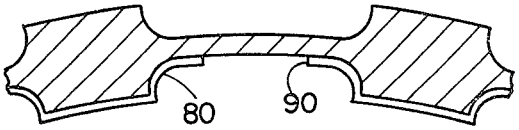

After completion of the photoresist exposure operation, the photoresist layer 80 is developed. The blank would then appear as shown in FIG. 14, the opening 90 corresponding to the areas exposed to ultraviolet light in the FIGS. 12–13 photoexposure operation.

Figure 15:
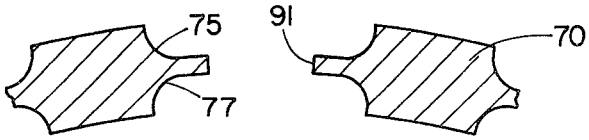
Figure 16:
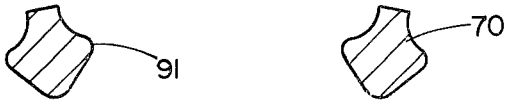
Figure 17:
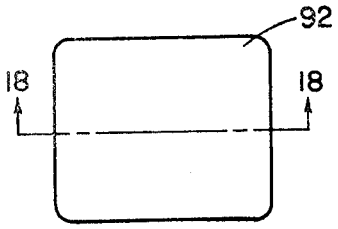
FIGS. 17–29 illustrate a preferred method of implementing the present invention.
Figure 19:
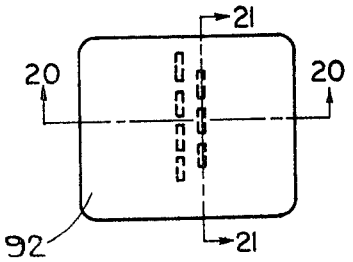
Figure 22:
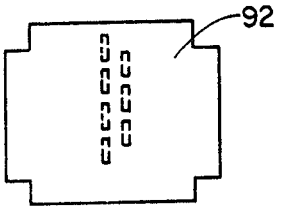
Figure 23:
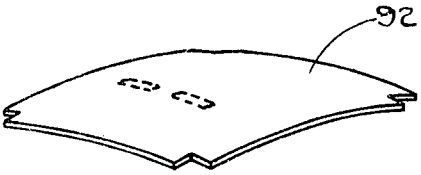

After development of the photoresist layer 80, the blank 70 is then again etched for a brief period of time to form through apertures 91 in the blank 70. FIGS. 15 and 16 are cross-sectional views taken through the apertures 91, transversely and longitudinally, respectively.

By way of example, during the first etching of the blank wherein the patterns of blind apertures 75, 77 are formed, the blank 70 may be etched about 40%–90% of the way through the blank. Assuming, for example, that a 6–7 mil thick blank were used, the blind apertures 75, 77 may be etched until about 1 mil of unetched blank material remains. It will be evident that the second etching operation need only be very brief since only a small amount of the mask blank remains to be etched.

Many of the details of the present method have been omitted in order not to obfuscate the present invention. Many of those details are clearly common to the method described in Pat. Nos. 3,975,198, 3,973,964 and 3,989,524 and can be drawn from those materials. Other details, where not given, may be drawn from standard practices in the art.

As intimated above, it will be understood that the method according to the present invention represents an improvement in the process described in U.S. Pat. Nos. 3,975,198, 3,973,964 and 3,989,524. First, the pre-etching of blind apertures in the mask blank before the blank is configured means that the etching operation by which through holes are formed in the blank may be very brief. An etchant-resistant aperture-defining layer on the blank is therefore not needed. The precision-forming of the blank with reference to indexing means formed in the blank and the provision of tolerance in the directions where tolerance is needed renders viable exposure by a fixed reference master. The photochemical formation of a pattern of through apertures which are correlative to a fixed-reference master stencil pattern in turn makes possible the interregisterability of the end product masks.

Another advantage of the present invention over the afore-described one-sided etch method lies in the fact that the first-etched blank (with the blind aperture patterns) can be made of conventional techniques at very high yields, due to the very low tolerance requirements encumbent on the first etching operation. High yields, of course, imply lower cost of manufacture. Secondly, because of the width of the blind apertures and the attendant reduced obstruction of the beam at the edges of the screen by the mask, it is expected that by the application of this invention there is permitted the use of thicker mask blank stock — for example, 10 mil thick stock as opposed to the conventional 6–7 mil stock. A thicker mask would have the effect of reducing mask "doming", i.e., a thermally induced swelling of the mask due to electron beam bombardment.

A second embodiment of the invention is depicted in FIGS. 17–29. The FIGS. 17–29 execution of the invention represents an improvement in some respects on the FIGS. 4–16 embodiment. The FIGS. 17–29 embodiment may be preferred to the FIGS. 4–16 embodiment in a number of respects, as will be pointed out hereinafter.

FIGS. 17–29 correspond closely to FIGS. 4–16; the operations represented by the various figures also correspond quite closely to those represented by FIGS. 4–16. The major points of distinction between the two methods will now be pointed out in some detail. The shadow mask blank 92 used for the FIGS. 17–29 method may be the same as that used in the FIGS. 4–16 method (see FIGS. 17–18). A major departure in the FIGS. 17–29 method comes however, in the step wherein the pattern of blind apertures is formed in the blank 92. In the practice of the FIGS. 17–29 method, a single flat photographic master (not shown), rather than a pair of masters, is employed. The blank 92 is coated with an etchant-resistant layer on both sides, however the layer 96 on the side of the mask blank 92 which will ultimately become the concave side of the mask need not be photosensitive. The photoresist layer 94 is photosensitive.

A flat photographic mask master may be used to expose the layer 94; the master may be the same as used to expose the photoresist layer 72 in the FIGS. 4–16 embodiment. However, as noted, no pattern of blind apertures is formed on the side of the blank 92 which will ultimately become the concave side of the mask.

Figure 20:
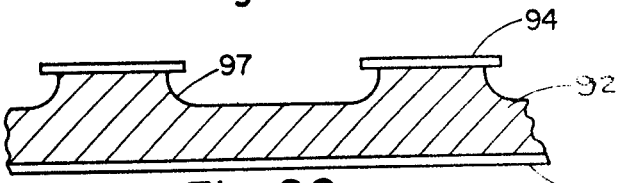
Figure 21:
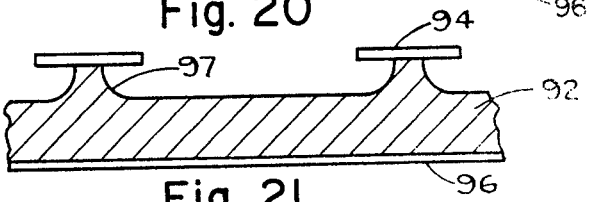
Figure 24:
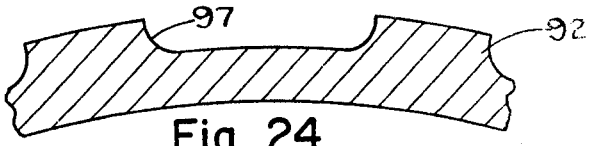

The photoresist layer 94 is then developed and the mask blank 92 etched to form a pattern of blind apertures 97 on one side of the blank 92 (see FIGS. 20 and 21). As in the FIGS. 4–16 embodiment, the mask blank with its pattern of blind apertures 97 on one side is then precision-shaped to take over the desired three-dimensional curvature. The precision shaping operation is conducted such that the pattern of blind apertures is located on the convex side of the blank (see FIGS. 23 and 24).

Figure 27:
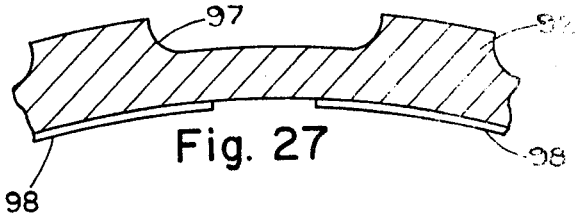
Figure 28:
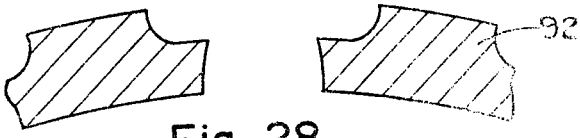
Figure 29:
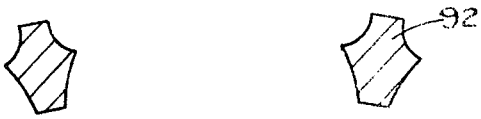

The formed mask blank is then coated on its concave surface with a layer 98 of photoresist. The photoresist layer 98 is exposed in the same way and with a mask of the same character as in FIG. 13 (see FIGS. 25 and 26). The photoresist layer is then developed (FIG. 27) and the blank 92 again etched, but from the concave side only. After stripping of the remaining photoresist layer 98, the end product appears, in transverse and longitudinal cross-section, as shown in FIGS. 28 and 29.

It is seen then, that the primary variations in the FIGS. 17–29 embodiment from the FIGS. 4–16 embodiment is the etching of blind apertures on only one side of the blank — the convex side of the end product mask. The second etching operation is again carried out from the concave side only, but because there is no pattern of blind apertures on the concave side, a number of advantages may obtain.

First, the mask blank 92 will be somewhat cheaper than the blank 70 since it is etched from one side only (thereby eliminating the need for two flat mask masters with their attendant registration requirements). Yet another possible advantage of the FIGS. 17–29 embodiment is that the etchant resist layer 96 can be less expensive than the photoresist layer 74 in the FIGS. 4–16 method since it needn't be photosensitive. Also, the layer 98 is more easily and uniformly applied to the smooth concave inner surface of the blank 92 than to the patterned concave surface of the formed blank 70.

Thirdly, it is possible that the mask blank 92 will be somewhat stronger than the blank 70 during the mask shaping operation since it has in a pattern of blind apertures on one side only. The mask blank 92 may thus have lower losses due to ripping of tie-bars during the mask shaping operation. It is also possible that the end product mask may ultimately have more material than that of the mask formed by the FIGS. 4–16 method, and thus have a somewhat alleviated mask doming problem. This is because it has been found that doming, particularly doming in localized regions of the mask, is roughly a function of the mask weight per unit area.

Figure 25:
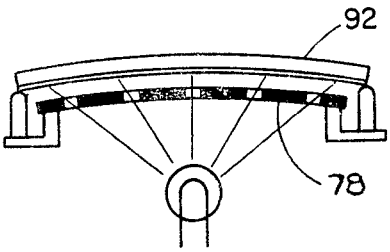
Figure 18:
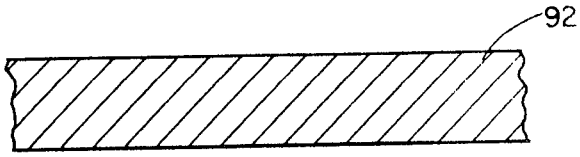
Figure 26:
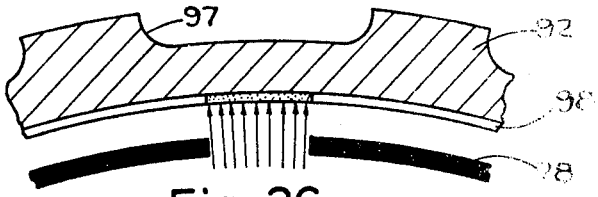

Whereas in each of the methods described above the initial mask blank is homogeneous — typically cold-rolled steel, it is contemplated that other mask blank structures may be employed to carry out the teachings of this invention. For example, a mask blank having high thermal conductivity for improved resistance to mask doming may be used. This material has, in the embodiment contemplated, a core of highly thermally conductive material sandwiched between outer layers of a different metal. For example, the mask blank may have a copper core about 1½ mils thick sandwiched between outer layers of cold-rolled steel each about 2½ mils thick. The formation of blind apertures on opposed sides of the blank could be carried out substantially as shown in FIGS. 4–8 above. By the choice of an etchant which is capable of rapidly etching cold-rolled steel, but relatively impotent to etch copper, the process controls to achieve the desired wall thickness at the mutual bottom of the opposed pairs of recesses would be relatively easier to achieve. After shaping the mask blank and recoating it with photoresist, the photoresist would be exposed and developed the same as depicted in FIGS. 25–27. The second etching operation would be carried out with an etchant which is capable of etching copper but one which is relatively inactive to etching steel. This would reduce the amount of etching of the steel layers during the second etching operation.

The advantage of the last-described process would, of course, be that the end product masks would have enhanced resistance to doming. The price which would have to be paid would be in the increased cost of the raw mask blank stock.

Still another variation on the method of the present invention is one in which the first and second etching operations are carried out exclusively from the side of the mask blank which ultimately becomes the convex side of the end-product mask. This variant generally follows the steps described above and illustrated in FIGS. 17–29. The step depicted by FIGS. 26–29 however is modified in that to accomplish the second etching operation, the photoresist layer is deposited on the convex side of the mask blank, the curved master is located contiguous to the convex side of the blank, and the exposure illumination is projected on the convex side of the mask and directed toward an imaginary point on the concave side of the mask simulating the ultimate center of electron beam deflection in the end-product tube. The photoresist development and second etching operations is carried out as described above.

Yet another variant of the above-described methods according to this invention is to first etch blind apertures in both sides of the mask blank, similar to the method described above and disclosed in FIGS. 4–16. However, rather than carrying out the second photoetching step by the use of a curved master disposed adjacent the concave side of the mask, again the photoexposure step preceding the second etching operation is carried out from the convex side of the mask blank, using a curved master disposed adjacent the convex side of the shaped blank. The second etching operation is carried out from the convex side, the concave side being protected by an etchant resist. Numerous other alterations, modifications and variations of the aforedescribed methods may be employed within the spirit and scope of the present invention and I therefore intend that the following claims embrace all such.

What is claimed is:

1. An improved method of making a curved color cathode ray tube shadow mask comprising:

providing flat mask master means and curved mask master means, said flat and curved mask master means having correlative master stencil patterns;

using said flat mask master means, photochemically forming in at least one side of a flat shadow mask blank a pattern of blind mask apertures whose individual blind aperture location is related to the end-product mask aperture location and whose individual blind aperture size, at least in a direction corresponding to the direction of electron beam scan across the mask is greater than the desired end product mask aperture size by a predetermined misregister tolerance value;

precision-shaping said flat mask blank into a predetermined three-dimensional configuration with the said pattern of blind apertures referenced to indexing means defined by the mask blank; and photochemically etching in the blank a pattern of through apertures coincident with said pattern of blind apertures but having individual through aperture size smaller by said predetermined tolerance value, at least in said scan direction, than said blind apertures, including using said curved mask master means as a photographic stencil while referencing it to said indexing means defined by the mask blank.

2. The method defined by claim 1 including mounting the end product curved mask in a color cathode ray tube with respect to said indexing means defined by the mask.

3. An improved method of making curved color cathode ray tube shadow masks having interregistrable electron beam-passing aperture patterns, comprising:

providing flat mask master means and curved mask master means, said flat and curved master means having correlative master stencil patterns;

using said flat mask master means, photochemically forming in at least one side of each of a plurality of flat shadow mask blanks a pattern of blind mask apertures whose individual blind aperture location is related to the end-product mask aperture location and whose individual blind aperture size, at least in a direction corresponding to the direction of electron beam scan across the mask, is greater than the desired end product mask aperture size by a predetermined misregister tolerance value;

precision-shaping each flat mask blank into a predetermined three-dimensinal configuration with the said pattern of blind apertures referenced to indexing means defined by the mask blank; and photochemically etching in each blank a pattern of through apertures coincident with said pattern of blind apertures but having individual through aperture size smaller by said predetermined tolerance value, at least in said scan direction, than said blind apertures, including using said curved mask master means as a photographic stencil while referencing it to said indexing means defined by the mask blank.

4. An improved method of making curved color cathode ray tube shadow masks having interregistrable electron beam-passing apertures comprising:

providing flat mask master means and curved mask master means, said flat and curved mask master means having correlative master stencil patterns;

using said flat mask mater means, photochemically forming in at least one side of each of a plurality of flat shadow mask blanks a pattern of blind mask apertures whose individual blind aperture location is related to the end-product mask aperture location and whose individual blind aperture size, at least in a direction corresponding to the direction of electron beam scan across the mask, is greater than the desired end product mask aperture size by a predetermined misregister tolerance value;

precision-shaping each flat mask blank into a predetermined three-dimensional configuration with the said pattern of blind apertures referenced to indexing means defined by the mask blank; and photochemically etching in each blank from the concave side only a pattern of through apertures coincident with said pattern of blind apertures but having individual through aperture size smaller by said predetermined tolerance value, at least in said scan direction, than said blind apertures, including using said curved mask master means as a photographic stencil while referencing it to said indexing means defined by the mask blank.

5. The method defined by clalim 4 including mounting the end product curved mask in a color cathode ray tube with respect to said indexing means defined by the mask.

6. An improved method of making color cathode ray tube shadow masks having interregistrable beam-passing slot patterns, comprising:

providing flat mask master means having a slot stencil pattern and curved mask master means having a vertical stripe stencil pattern correlative to columns of slots in said slot stencil pattern but having a stripe width less than the width of an associated slot in said stencil pattern and devoid of any stencil pattern component corresponding to tie-bars between the end-product mask slots;

using said flat mask master means, photochemically etching in at least one side of each of a plurality of flat shadow mask blanks a pattern of blind mask slots whose individual blind slot location is related to the end-product mask slot location and whose individual blind slot size in the horizontal direction is greater than the desired end-product mask slot size by a predetermined misregister tolerance value;

precision-shaping each flat mask blank into a predetermined three-dimensional configuration with said pattern of blind slots being referenced to indexing means defined by the mask;

using said curved mask master means while referencing same to said indexing means and photochemically etching in each blank a pattern of through slots coincident with said pattern of blind slots but having individual through slots narrower by said predetermined tolerance value, at least in the horizontal direction, than said blind apertures.

7. An improved method of making curved color cathode ray tube shadow masks having interregistrable beam-passing aperture patterns, comprising:

providing flat mask master means and a curved mask master, said flat and said curved mask master having correlative master stencil patterns;

using said flat mask master means, photochemically forming in at least one side of each of a plurality of flat shadow mask blanks a pattern of blind mask apertures whose individual blind aperture location is related to the end-product mask aperture location and whose individual blind aperture size, at least in a direction corresponding to the direction of electron beam scan across the mask, is greater than the desired end product mask aperture size by a predetermined misregister tolerance value;

precision-shaping each flat mask blank into a predetermined three-dimensional configuration with said pattern of blind apertures on the convex side of the curved mask and with the said pattern referenced to indexing means defined by the mask; and photochemically etching in each blank from the concave side only a pattern of through apertures coincident with said pattern of blind apertures but having individual through aperture size smaller by said predetermined tolerance value, at least in said scan direction, than said blind apertures, including using said curved mask master as a photographic stencil while referencing it to said indexing means defined by the mask blank.

8. The method defined by claim 7 including mounting said curved mask in a color cathode ray tube with respect to said indexing means defined by the mask.

9. An improved method of making curved color cathode ray tube shadow masks having interregistrable beam-passing aperture patterns, comprising:

providing a pair of flat mask masters and a curved mask masters, said masters having thereon correlative master stencil patterns;

using said flat mask masters, photochemically forming in each of a plurality in both sides of each of plurality of flat shadow mask blanks registered patterns of blind mask apertures whose individual blind aperture location is related to the end-product aperture location and whose individual blind aperture size, at least in the direction corresponding to the direction of electron beam scan across the mask, is greater than the desired end-product mask aperture size by a predetermined misregister tolerance value;

precision-shaping each flat mask blank into a predetermined three-dimensional configuration with said patterns of blind apertures on the convex and concave sides of the curved mask blank referenced to indexing means defined by the mask blank; and photochemically etching in each blank from the concave side only a pattern of through apertures coincident with said registered patterns of blind apertures but having individual through apertures smaller by said predetermined tolerance value, at least in said scan direction, than said blind apertures, including using said curved mask master as a photographic stencil while referencing it to said indexing means defined by said mask blank.

10. An improved method of making and mounting color cathode ray tube shadow masks having interregistrable beam-passing slot patterns, comprising:

providing a pair of flat mask masters having correlative vertical slot stencil patterns and a curved mask master having a vertical stripe stencil pattern correlative to columns of slots in said slot stencil patterns but having a stripe width less than the width of an associated slot in said stencil pattern and devoid of any stencil pattern component corresponding to tie-bars between the end-product mask slot;

using said flat mask master, photochemically etching in both sides of each of a plurality of flat shadow mask blanks registered patterns of blind mask slots whose individual blind slot location is related to the end-product mask slot location and whose individual blind slot size in the horizontal direction is greater than the desired end-product mask slot size by a predetermined misregister tolerance value, the collective depth of each registered opposing pair of said blind slots representing about 40% to 90% of the thickness of said blank;

precision-shaping each flat mask blank into a predetermined three-dimensional configuration with said registered patterns of blind slots being referenced to indexing means defined by the mask;

using said curved mask master while referencing it to said indexing means and photochemically etching in each blank from the concave side only a pattern of through slots coincident with said registered patterns of blind slots but having individual through slots narrower by said predetermined tolerance value, at least in the horizontal direction, than said blind apertures; and mounting each of the resulting curved masks on the faceplate of a color cathode ray tube while referencing a pattern of phosphor elements on the faceplate to said indexing means defined by the mask and thus to said pattern of through slots in the mask.

* * * * *